US006718796B2

(12) United States Patent
Baum et al.

(10) Patent No.: US 6,718,796 B2
(45) Date of Patent: Apr. 13, 2004

(54) DESIGN FEATURE FOR DISTINGUISHING ONE EARRING OF A SET FROM THE OTHER

(75) Inventors: Robert Baum, New York, NY (US); Laura Leoni, Freeport, NY (US)

(73) Assignee: Robert A. Baum Corporation, New York, NY (US)

( * ) Notice: Subject to any disclaimer, the term of this patent is extended or adjusted under 35 U.S.C. 154(b) by 0 days.

(21) Appl. No.: 10/338,016

(22) Filed: Jan. 7, 2003

(65) Prior Publication Data

US 2003/0089129 A1 May 15, 2003

Related U.S. Application Data

(62) Division of application No. 09/476,663, filed on Jan. 3, 2000, now abandoned.

(51) Int. Cl.[7] ..... A44C 7/00
(52) U.S. Cl. ..... 63/12; 63/13; 63/14.1
(58) Field of Search ..... 63/12, 13, 14.1

(56) References Cited

U.S. PATENT DOCUMENTS

| | | | | |
|---|---|---|---|---|
| 241,462 | A | | 5/1881 | Washburn |
| 248,240 | A | | 11/1881 | Washburn |
| 360,423 | A | | 4/1887 | Edge |
| 421,433 | A | | 2/1890 | Rees |
| 1,262,519 | A | | 4/1918 | Kline |
| 2,034,503 | A | | 3/1936 | Barnes |
| 2,455,236 | A | | 11/1948 | Darvie et al. |
| 2,715,821 | A | | 8/1955 | Herbert |
| 2,813,407 | A | | 11/1957 | Arzt |
| 3,122,007 | A | | 2/1964 | Horland |
| 3,176,475 | A | | 4/1965 | Saccoccio |
| 3,258,858 | A | | 7/1966 | Cariffe, Jr. |
| 3,418,826 | A | | 12/1968 | Wieshuber |
| 3,906,642 | A | | 9/1975 | Cohen |
| 4,003,216 | A | | 1/1977 | Cecere et al. |
| 4,214,456 | A | * | 7/1980 | Hannum ..... 63/12 |
| 4,724,684 | A | * | 2/1988 | Barnett ..... 63/14.1 |
| 4,832,606 | A | | 5/1989 | Clark et al. |
| 4,907,424 | A | | 3/1990 | Reinstein et al. |
| 4,944,164 | A | | 7/1990 | Butler et al. |
| 5,025,643 | A | | 6/1991 | Chan et al. |
| 5,165,258 | A | | 11/1992 | Kogen |
| 5,240,418 | A | | 8/1993 | Silverman et al. |
| 5,433,089 | A | | 7/1995 | Timbal |
| 5,487,280 | A | | 1/1996 | D'Amore, Jr. |
| 5,829,273 | A | | 11/1998 | Weingast et al. |
| 5,964,105 | A | * | 10/1999 | Nakamura ..... 63/14.1 |
| 2002/0095953 | A1 | * | 7/2002 | Bonifacio ..... 63/12 |
| 2003/0089128 | A1 | * | 5/2003 | Minassian ..... 63/4 |
| 2003/0089129 | A1 | * | 5/2003 | Baum et al. ..... 63/12 |

FOREIGN PATENT DOCUMENTS

GB 295827 8/1928

OTHER PUBLICATIONS broadwaterrosejewels.com website printout for "Vintage Mexican Sterling", discussing a maker's mark on one of a set of earrings.* broadwaterrosejewels.com website closeup for "Vintage Mexican Sterling" earring showing maker's mark.*

* cited by examiner

*Primary Examiner*—J. J. Swann
*Assistant Examiner*—Dinesh Melwani
(74) *Attorney, Agent, or Firm*—Buckley, Maschoff & Talwalkar LLC

(57) ABSTRACT

The back portion of an omega-back earring is formed by investment casting and then heat-treated to have spring gold characteristics. A rear surface of the ornamental front portion of the earring includes a depression to present a concave profile which is complementary to the convex profile of the pushing part of the rear portion of the earring. In a non-identical mirror-image pair of earrings, a design element such as a small precious stone is provided on only one of the earring pair, at an inconspicuous spot, to aid the wearer in distinguishing the right earring from the left earring.

4 Claims, 2 Drawing Sheets

DESIGN FEATURE FOR DISTINGUISHING ONE EARRING OF A SET FROM THE OTHER

CROSS REFERENCE TO RELATED APPLICATION

This is a division of prior U.S. patent application Ser. No. 09/476,663, filed Jan. 3, 2000 now abandoned.

FIELD OF THE INVENTION

This invention relates generally to jewelry and more particularly to earrings.

BACKGROUND OF THE INVENTION

Omega-back earrings are well known. Somewhat typical examples of omega-back earrings are illustrated in U.S. Pat. Nos. 4,907,424 and 5,165,258.

Earrings of this type include a decorative portion which is worn on the outside or front surface of the earlobe. A pin or post projects inwardly from the decorative portion of the earring and is intended to be inserted through a hole in the earlobe. A rear portion of the earring is attached to the decorative portion by a hinge at the bottom of the decorative portion. The upper end of the rear portion of the earring is in the form of a loop. When the earring is in a closed condition attached to the wearer's ear, the loop of the rear portion of the earring presses against the back of the wearer's earlobe and the post from the front of the earring extends through the loop.

In general, omega-back earrings represent a desirable combination of secure attachment to the wearer's ear and relative comfort. But comfort in an earring is almost always a relative matter, and it would be highly desirable to improve even omega-back earrings from the point of view of the wearer's comfort. It would also be desirable to reduce the cost of manufacture of omega-back earrings.

Earrings are generally sold in pairs. In many cases, the two earrings making up the pair are identical and may be interchangeably worn on either ear. However, other earring designs call for a pair of earrings in which the two earrings are not identical, but rather are mirror-images of each other, with one piece intended for wearing only on the right ear, and the other intended for wearing only on the left ear. One disadvantage of such mirror-image earring pairs, not heretofore remarked in the prior art, is that the wearer often finds, upon putting on the earrings, that she has mistakenly placed the left earring on her right ear or vice versa. It would be desirable to prevent this sort of inconvenience. It is to be recognized that this problem may be encountered in omega-back earrings and other types of earrings as well.

OBJECTS AND SUMMARY OF THE INVENTION

It is an object of the invention to provide an improved omega-back earring.

It is a further object to provide an omega-back earring that is more comfortable to wear than prior art designs.

It is another object of invention to provide a method of making an omega-back earring at lower cost and with greater convenience than conventional methods.

It is still a further object of the invention to provide a pair of non-identical mirror-image earrings in which the right earring can be easily distinguished from the left earring.

A first aspect of the invention provides an improvement in an pair of earrings, where one of the earrings is intended for wearing on a user's left ear, the other of the earrings is intended for wearing on the user's right ear, the earrings have respective ornamental surfaces for facing in a direction oriented outwardly from the ear on which the respective earring is worn, the respective ornamental surfaces are non-identical mirror-images of each other, and the improvement includes providing on one of the earrings a design feature not present on the other of the earrings, with the design feature being for distinguishing the first one of the earrings from the other one of the earrings to indicate to the user on which ear the first one of the earrings is to be worn. The design feature may be a precious or semi-precious stone located on a rear surface of the first one of the earrings, the rear surface being oriented in the direction opposite to the respective ornamental surface of the first one of the earrings. For example, the design feature may be a small ruby mounted on the rear of the front portion of the right earring.

A second aspect of the invention provides an improvement in an omega-back earring having a front portion for adorning an outward surface of a wearer's ear and a back portion mounted by a hinge to the front portion, the front portion having a first surface for facing in a direction oriented outwardly from the wearer's ear and a second surface for contacting the wearer's earlobe, the front portion also having a post extending from the second surface, the post being arranged to be inserted through a hole pierced in the wearer's earlobe, the back portion including a loop for defining an aperture through which the post is inserted when the earring is attached to the wearer's ear in a closed condition, the loop defining a convex configuration relative to the wearer's earlobe when the earring is attached to the wearer's ear in a closed condition. The improvement in accordance with this aspect of the invention provides that the second surface of the front portion has a bowl-like region from which the post extends, the bowl-like region being arranged to define a concave configuration relative to the wearer's earlobe, the concave configuration being complimentary to the convex configuration defined by the loop by the back portion, the loop of the back portion and the bowl-like region of the front portion being for engaging therebetween the wearer's earlobe when the earring is attached to the wearer's ear in the closed condition. The bowl-like region on the rear (second) surface of the front portion of the earring may also be employed with a rear portion loop that does not define a convex configuration.

According to a third aspect of the invention, an omega-back earring includes a front member for adorning an outward surface of a wearer's ear, the front member having a front surface for facing in a direction oriented outwardly from the wearer's ear, and a rear surface for contacting the wearer's earlobe, the front member including a post extending from the rear surface for being inserted through a hole pierced in the wearer's earlobe, the front member having a hinge portion at a lower end of the front member, the earring also including a rear member for engaging a rear surface of the wearer's earlobe, the rear member including a loop at a upper end of the rear member, the loop being arranged to define an aperture through which the post is inserted when the earring is attached to the wearer's ear in a closed condition, the rear member having a hinge portion at a lower end of the member, the respective hinge portions of the front and rear members cooperating to form a hinge by which the rear member is pivotable between the closed condition and open condition, the rear member being formed by investment casting as a single, unitary body, and being composed entirely of spring gold.

According to a fourth aspect of the invention, there is provided a method of manufacturing a hinged earring, the method including the steps of providing a front portion of the earring, forming a rear portion of the earring by investment casting from a material that includes gold, processing the rear portion of the earring to harden the rear portion so that the rear portion has characteristics of spring gold, and assembling the front portion and the processed rear portion to form the hinged earring. The processing of the rear portion of the earring preferably includes heat-treating the rear portion at a first temperature and then water quenching the rear portion, followed by heat-treating the rear portion again at a lower temperature, and then air cooling.

An earring provided in accordance with the foregoing aspects of the invention provides the following advantages:

The provision of a distinctive design element on one, but not the other, of a mirror-image pair of earrings enables the wearer to quickly and easily distinguish between the right earring and the left earring before putting on the earrings, thereby preventing the possible inconvenience of initially placing the earrings on the wrong ear. In addition, this feature, by guiding the wearer to a correct placement of the earrings, helps to assure that precious stones or other design elements, intended to be prominently displayed, actually receive the intended prominence.

In addition, the concave region provided on the rear surface of the front of the earring substantially enhances the wearer's comfort by more appropriately distributing forces applied by the earring to the wearer's earlobe.

Furthermore, the above-mentioned technique for forming a one-piece rear portion of an omega-back earring of spring gold reduces the cost of manufacture and assembly of omega-back earrings.

The foregoing and other objects, features and advantages of the invention will be further understood from the following detailed description of the preferred embodiments thereof and from the drawings, wherein like reference numerals identify like components and parts throughout.

DESCRIPTION OF PREFERRED EMBODIMENTS

Figure 1:
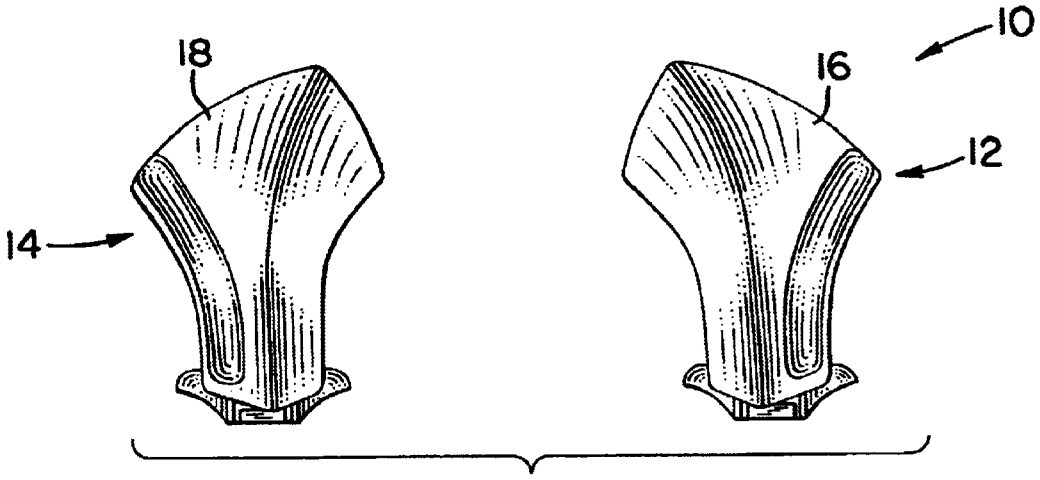
FIG. 1 is a front elevational view of a pair of earrings provided in accordance with the invention.

FIG. 1 shows a pair of earrings 10, including a right earring 12 intended for wearing on a right ear, and a left earring 14 intended for wearing on a left ear. Seen in FIG. 1 are respective front ornamental surfaces 16 and 18 of the right and left earrings 12 and 14.

Figure 2:
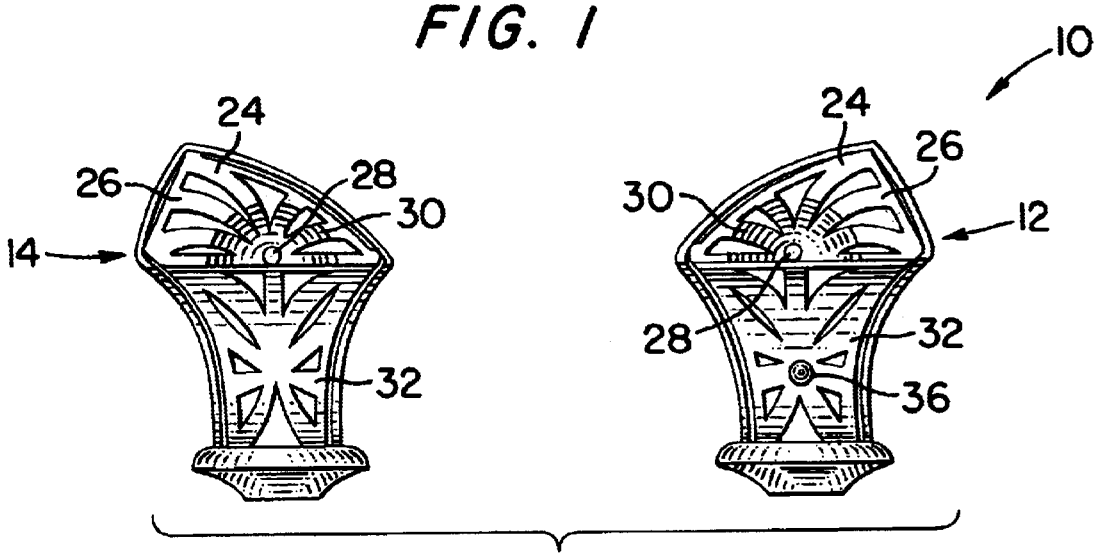
FIG. 2 is a rear elevational view of the earrings of FIG. 1.
Figure 3:
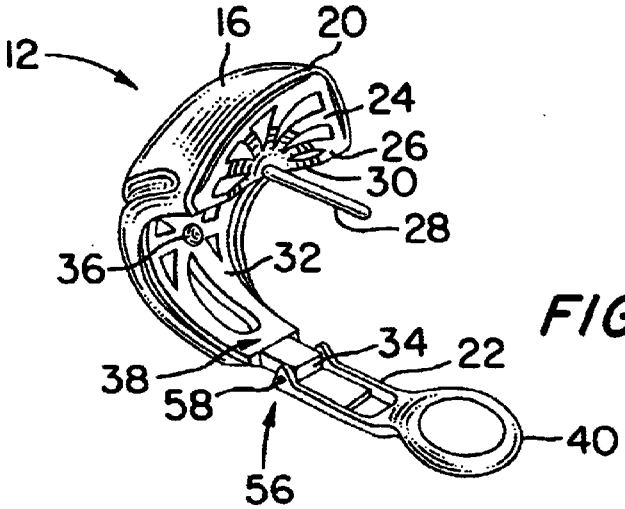
FIG. 3 is a perspective view showing the rear of one of the earrings when it is in an open condition.
Figure 4:
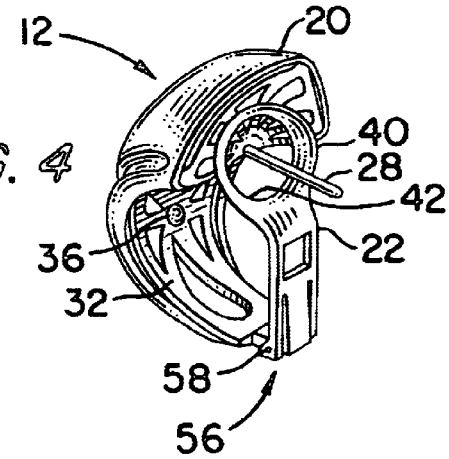
FIG. 4 is a view similar to FIG. 3, showing the earring in a closed condition.

FIG. 2 provides an elevational view of the earrings 12, 14 as seen from the rear, and FIGS. 3 and 4 show the right earring 12, in a perspective view, seen from behind in an open condition and in a closed condition, respectively.

The component parts which make up the earring are best seen in FIG. 3. The previously mentioned ornamental surface 16 is carried as front surface on a front portion 20 of the earring 12. The other main component of the earring is a rear or back portion 22.

The front portion 20 has a rear surface 24 which faces in a direction opposite to the front ornamental surface 16. An upper segment 26 of the rear surface 24 is generally planar (except for interruptions due to the filigree design of the rear surface) and is to be in contact with the wearer's earlobe when the earring is being worn. A post 28 extends from the upper segment of the rear surface 24 and is surrounded by a depression 30. The post 28 is provided to be inserted through a hole pierced in the wearer's earlobe. The depression 30 presents a concave space to the outer surface of the wearer's earlobe and can also be considered to define a bowl-like region, or more precisely in the embodiment shown in FIGS. 1–4, a hemi-bowl-like area. Because of the filigree of the surface 24, it will be recognized that the depression 30 is formed in a filigree surface.

Below the upper segment 26 of the rear surface 24 there is a lower segment 32 which curves outwardly and downwardly away from the wearer's ear and then back toward the ear when the earring is worn, terminating in a squared-off lower end 34 of the front portion 20 of the earring (FIG. 3).

A design element 36, which may be a small semi-precious or synthetic or precious stone such as a ruby, is mounted at a central portion of the lower segment 32 of the rear surface 24 of the front portion 20 of the right earring 12. A comparison of the rear surface of the left earring 14 with the rear surface of the right earring 12 (FIG. 2) shows that the design element 36 is not present on the left earring 14. Consequently, the design element 36 serves to distinguish the right earring 12 from the left earring 14. Embodying the design element 36 as a small ruby is particularly advantageous in that a mnemonic phrase such "red, right, ruby" may easily be recalled by the wearer to assist her in recollecting in that the right earring is marked by the design element. With the provision of the design element 36, the wearer is enabled to readily distinguish the right earring 12 from the left earring 14 (the same being otherwise perfect mirror-images of each other) so that the wearer can avoid the inconvenient, and possibly embarrassing, circumstance of mixing up the placement of the earrings on the wearer's ears. Another advantage of this feature is that the wearer is guided to place the earrings so that any precious stones or other design elements intended to be prominently displayed are in fact so displayed.

It should be noted that design element 36 can be placed in locations other than the one shown in FIGS. 2–4. For example, it may be placed at a point indicated by arrow 38 near the bottom of the lower segment 32 of the rear surface 24 (FIG. 3). Other placements are possible, but it should be understood that preferably design element 36 would not be placed on the ornamental front surface 16 so as not to detract from the apparent symmetry of the earring pair. It is also contemplated that the design element 36 may be placed only on the left earring 14, instead of the right earring 12. Design elements other than a decorative stone may be employed. Such other alternative design elements may include a mark or engraving, or a protrusion or projection of the metal material of which the earring is made.

Consideration will now be given to the rear portion 22 of the earring and its cooperative effect with the above-described depression 30 of the front portion 20 of the earring.

The rear portion 22 has, as its upper section, a loop 40 which defines an aperture 42. As seen from FIG. 4, the post 28 of the front portion 20 is inserted through the aperture 42 when the earring is in its closed condition. The diameter of the aperture 42 is several times greater than the diameter of the post 28, in accordance with a conventional omega-back configuration. As best seen from FIGS. 4, 6 and 7, the loop 42 defines a partial cup surface, in accordance with a known practice, to present a convex profile toward the rear-side of the wearer's earlobe. The concave profile presented by the depression 30 is matching or complementary to the convex profile of the loop 40 of the rear portion 22. The depression 30 acts as a complementary pressure surface relative to the loop 40.

The depression 30 greatly enhances the comfort of the wearer, by more satisfactorily distributing the forces applied to the earlobe by the pinching of the earlobe between the upper segment 26 of the rear surface 24 of the front portion 20 and the loop 40 of the rear portion 22.

Figure 5:
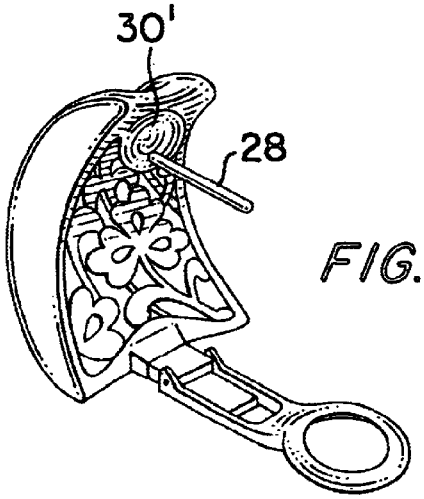
FIG. 5 is a view, similar to FIG. 3, of another earring provided in accordance with the invention.

FIG. 5 illustrates an alternative embodiment of the invention, in which the depression 30' defines a full bowl-shaped area, rather than a hemi-bowl as in the embodiment of FIGS. 2–4. In the embodiment of FIG. 5, the depression 30' generally surrounds the point at which the post 28 is mounted to the earring, but the point of mounting of the post 28 is off-set downwardly by a small distance from the center of the depression 30'.

Further details of the back portion 22 of the earring will now be described with reference to FIGS. 6 and 7. At an opposite (lower) end of the rear portion 22 from the, loop 40, longitudinal slots 44 and 46 are provided to define therebetween a leaf spring section 48. Adjacent leaf spring section 48 are hinge portions 50 and 52, in which holes 54 are defined, respectively. The hinge portions 50 and 52 of the back portion 22 cooperate with a channel (not shown) running transversely through the squared-off lower end 34 of the front portion 20 to form a hinge 56 (FIGS. 3 and 4). The hinge is completed by a hinge pin 58 which passes through the holes 54 and the channel in the end 34. An aperture 60 is defined at a central portion of the back portion 22 so as to reduce the precious metal weight of the back portion 22.

Conventional practice calls for making the back of an omega-back earring either of a spring gold wire, or as a combination of a cast finding having the convex-profile loop shown herein, together with a tongue or slab of spring gold mounted in the lower end of the finding. The former practice is disadvantageous in that the simple wire loop is not conducive to comfort. However, the second prior art practice requires a burdensome and labor-intensive step of mounting the spring gold tongue in the cast finding.

It is a feature of the present invention that the back portion 22 is cast in gold alloy as a single unitary piece including the leaf spring portion 48, and then the cast finding is suitably treated to produce hardness and resiliency substantially characteristic of spring gold.

Figure 6:
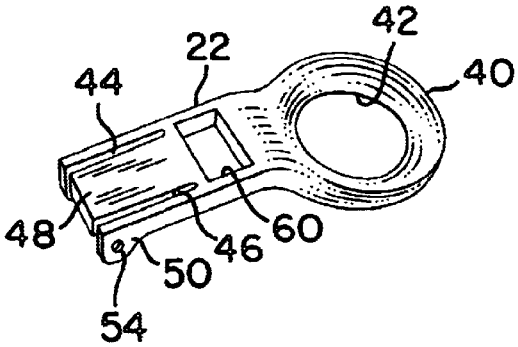
FIG. 6 is a perspective view showing a rear side of a rear portion of the earrings of FIGS. 1–5.
Figure 7:
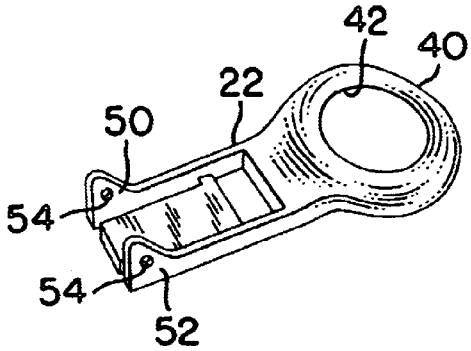
FIG. 7 is a perspective view showing a front side of the earring rear portion of FIG. 6.

According to a preferred embodiment of the invention, a gold alloy designated as number 174C, commercially available from Touchstone Metal, Providence, Rhode Island, is formed by investment casting into the back portion configuration shown in FIGS. 6 and 7. This is a 14K gold alloy and is believed to have substantial silver content, perhaps 30% or more. After casting, the rear portion or finding 22 is subjected to a regime of heat-treatment to provide hardness and resiliency substantially like that of conventional spring gold. Satisfactory results have been obtained by heating the casting to 1200° F. for 15 minutes and water quenching, followed by heating again to 600° F. for two hours, and then slow (i.e. air) cooling.

The cast and heat-treated back portion 22 is then assembled with the front portion 20 to provide the omega-back earring of the present invention. After assembly, the leaf spring portion 48 of the back portion 22 interacts with the squared-off end 34 of the front portion 20 so that the back portion 22 is pivotable between the open and closed positions of FIGS. 3 and 4 with a "snap" or "click" action such that the only stable positions are those shown in FIGS. 3 and 4. The resilience characteristics treated into the back portion 22 are needed to maintain pressure on the wearer's earlobe when the earring is worn, and to permit the leaf spring portion 48 to negotiate a corner of the squared-off lower end 34 of the front portion 20 as the back 22 moves between the open and closed positions.

By providing a one-piece casted and heat-treated finding 22, the present invention allows for easy and cost-effective assembly of the earring, in a style having a high degree of comfort for the wearer. Also, the leaf spring section 48, is shorter in length than the spring gold tongue according to conventional practice, and therefore is stiffer and so provides a more effective click action than the conventional spring gold tongue. Also, the one-piece spring gold rear portion 22 of the present invention does not suffer from the disadvantage of the prior art arrangement that the spring gold tongue may separate from the cast finding and become lost.

In a preferred practice of the invention, the front portion 20 is also made by investment casting in a gold alloy such as 14K yellow or white gold, but without any need for heat-treating the front portion. The special alloy used for the rear portion need not be used for the front portion. The post 28 is soldered to the front portion and the casted and heat-treated back portion is hingedly mounted to the front portion via the hinge pin 58. Thus, the earring is assembled of four pieces, of which two are made by investment casting.

Although a preferred embodiment of the invention incorporates all three novel features described above, namely the depression 30 or 30', the design element 36 and the one-piece casted and heat-treated back 22, any one or two of these features may be omitted. It should also be understood that the ornamental design of the earring shown herein is subject to many variations. It is also contemplated to execute the designs shown herein in precious metals other than gold, or in non-precious metals or other materials.

The depression 30 or 30' may be paired with a back which lacks the cup configuration shown in the drawings. For example, a back formed of a spring gold wire loop may be employed.

Various other changes in the above-disclosed earrings may be introduced without departing from the invention. The particularly preferred embodiments disclosed herein are thus intended in an illustrative and not limiting sense. The true spirit and scope of the invention are set forth in the following claims.

What is claimed is:

1. In a pair of earrings, one of said earrings intended for wearing on a user's left ear, the other of said earrings intended for wearing on the user's right ear, said earrings having respective ornamental surfaces for facing in a direction oriented outwardly from the ear on which the respective earring is worn, said respective ornamental surfaces being mirror images of each other, the improvement wherein a first one of said earrings has a design feature not present on the other one of said earrings, said design feature for distinguishing said first one of said earrings from the other one of said earrings to indicate to the user on which ear the first one of said earrings is to be worn;

wherein said design feature is located on a rear surface of said first one of said earrings, said rear surface oriented in a direction opposite to said respective ornamental surface of said first one of said earrings;

wherein said design feature is of a color which contrasts with a color of said rear surface.

2. In a pair of earrings, one of said earrings intended for wearing on a user's left ear, the other of said earrings intended for wearing on the user's right ear, said earrings having respective ornamental surfaces for facing in a direction oriented outwardly from the ear on which the respective earring is worn, said respective ornamental surfaces being mirror images of each other, the improvement wherein a first one of said earrings has a design feature not present on the other one of said earrings, said design feature for distinguishing said first one of said earrings from the other one of said earrings to indicate to the user on which ear the first one of said earrings is to be worn;

wherein said design feature is located on a rear surface of said first one of said earrings, said rear surface oriented in a direction opposite to said respective ornamental surface of said first one of said earrings;

wherein said design feature comprises a precious or semi-precious or synthetic stone.

3. The pair of earrings according to claim 2, wherein said design feature comprises a ruby.

4. The pair of earrings according to claim 3, wherein said first one of said earrings is intended for wearing on the user's right ear.

* * * * *

UNITED STATES PATENT AND TRADEMARK OFFICE

CERTIFICATE OF CORRECTION

PATENT NO. : 6,718,796 B2
DATED : April 13, 2004
INVENTOR(S) : Robert Baum

It is certified that error appears in the above-identified patent and that said Letters Patent is hereby corrected as shown below:

Title page,
Item [73], Assignee, should read:

Signed and Sealed this

Twenty-fifth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,718,796 B2
DATED : April 13, 2004
INVENTOR(S) : Robert Baum

It is certified that error appears in the above-identified patent and that said Letters Patent is hereby corrected as shown below:

Title page,
Item [73], Assignee, should read:
-- Robert Baum, New York, NY (US) --

This certificate supersedes Certificate of Correction issued May 25, 2004.

Signed and Sealed this

Seventh Day of December, 2004

JON W. DUDAS
*Director of the United States Patent and Trademark Office*